United States Patent [19]

Guffey

[11] 4,428,610

[45] Jan. 31, 1984

[54] METHOD AND COLLAPSABLE FRAME FOR COLLECTING AND DISPOSING OF ANIMAL EXCREMENT

[76] Inventor: Robert W. Guffey, 266 Fairmont Ave., San Carlos, Calif. 94070

[21] Appl. No.: 401,629

[22] Filed: Jul. 26, 1982

[51] Int. Cl.[3] ..... A01K 29/00

[52] U.S. Cl. ..... 294/1 B; 294/19 R; 294/55

[58] Field of Search ..... 294/1 BA, 1 B, 1 BB, 294/19 R, 51, 52, 53.5, 55; 15/104.8, 257.1, 15/257.4, 257.7

[56] References Cited

U.S. PATENT DOCUMENTS

| | | | |
|---|---|---|---|
| 3,739,418 | 6/1973 | Yonaites et al. | 15/104.8 |
| 3,806,984 | 4/1974 | Hilsabeck | 15/257.7 |
| 3,813,121 | 5/1974 | Marvin | 294/1 R |
| 3,827,098 | 8/1974 | Sanderson | 294/1 BA |
| 3,978,540 | 9/1976 | Peck | 15/104.8 |
| 3,986,744 | 11/1976 | Krogstad et al. | 294/55 |
| 4,019,768 | 4/1977 | Niece | 294/19 R |
| 4,103,952 | 8/1978 | Thompson | 294/1 R |
| 4,146,259 | 3/1979 | Schultz | 294/1 BA |
| 4,148,510 | 4/1979 | Brack | 294/1 R |
| 4,205,869 | 6/1980 | Mathis | 294/1 B |
| 4,272,116 | 6/1981 | Tufte, Jr. | 294/1 B |

*Primary Examiner*—James B. Marbert

[57] ABSTRACT

The present invention provides a folding frame having a molded handle portion and a wire hoop portion. In the folded configuration the wire hoop is snappedly retained in generally the same plane as the molded handle. When deployed for use, the wire hoop portion is rotated into position with the cross member of the wire hoop being forward of, and below, the forward edge of the molded handle. For use in picking up animal excrement a plastic bag is installed on the deployed frame. This is done by inserting the bag extending back beneath the molded handle and the top of the bag is folded back over the wire hoop and molded handle. During use only one side of the interior portion of the plastic bag comes into contact with the excrement, thus making it possible to remove the bag and dispose of it without soiling ones hands or clothing. Additionally, the folding frame also remains clean allowing it to be refolded and returned to the pocket or purse without cleaning.

2 Claims, 4 Drawing Figures

METHOD AND COLLAPSABLE FRAME FOR COLLECTING AND DISPOSING OF ANIMAL EXCREMENT

BACKGROUND OF THE INVENTION

This invention relates to a portable, reuseable collapsable frame for coupling with a pliable bag for the primary purpose of collecting and disposing of animal excrement.

In the past few years there has been an increasing public concern regarding the problem of environmental pollution caused by the prevalent practice of animal pet owners permitting their animals to deposit solid excrement on both private and public property. In highly populated areas, such as cities, the excrement from pets results in annoyance to the caretaker and other individuals. Some cities have laws requiring the owner of a pet to clean up solid excrement and properly dispose of same.

Heretofore, when the animal dropped excrement, the attendant was placed in an embarassing position of having to carry an ackwardly conspicuous implement for collecting the animal excrement.

There have been several devices proposed for the collection and disposal of animal excrement. For example, in U.S. Pat. No. 4,019,768; there is disclosed a portable device for scooping animal excrement. Also in U.S. Pat. No. 3,986,744, there is disclosed a portable device for scooping animal excrement. A problem with each of these devices is that they are ackward and conspicuous to carry and they require cleaning after each use. Therefore it may be considered to be an unwanted accessory and as a result the device may not be used.

Another prior art device is disclosed in U.S. Pat. No. 4,205,869 consisting of a cardboard container with a plastic liner and paddle for pushing excrement into the bag. Although, probably easily carried, this device requires two hands which could present problems if the dog were tugging on the leash. Also the reuseable part of this device is made of cardboard which has questionable service life.

Yet another prior art device is disclosed in U.S. Pat. No. 3,806,984. This device is similar to a small purse and since the closure portion is also the pick-up edge of the device it will have an exposed residue on the outer portion thereof after use.

What is needed is a device which can be used with one hand, does not require cleaning after use, has a collapsable reusable handle, and has a bag portion which can be closed and disposed of easily with out leaving any exposed residue which may transfer to the user or the user's clothing before it can be properly disposed of.

SUMMARY OF THE INVENTION

In accordance with the preferred embodiment, the present invention is a folding frame comprising a rigid "T" shaped handle and a pivotable wire hoop. The pivotable wire hoop can be secured in the stowed position, i.e., hoop sides parallel with the handle and the bottom of wire hoop in recess at end of handle. In this position, the frame is easily carried in an individual's pocket or purse. While walking the animal, when the occasion dictates, the frame is removed from said pocket or purse. The pivoting wire hoop is positioned approximately 240° from its stowed position into a position forming a rectangular support with the cross portion of the wire hoop generally parallel to, forward of, and below the forward edge of the handle. Whereas the forward edge of the handle forms the top portion of said rectangle with the wire hoop forming the two sides and bottom. A plastic bag is inserted, closed end first, through the supporting rectangle and extending in the direction of the central leg of the "T" shaped handle. The open end of the bag is then folded back around the exposed wire hoop encompassing same. The bag is folded back until the open end of said bag is at least even with the closed end of the bag. The thumb is then positioned such that the bag is caught beneath the thumb and handle portion of the frame. Now the scoop is ready for use. By positioning the scoop such that the plastic bag opening across the cross portion of the wire loop is in planar alignment with the surface on which the excrement is deposited, then with a scooping motion, pass that portion of the bag under the excrement which is then captured in the bag. The bag may now be removed and disposed of appropriately without soiling hands or clothing by unfolding the bag from the side around the handle. The unsoiled pivotable wire hoop can then be returned to the stow position and the frame returned to the individual's pocket or purse.

The economy of this device should be noted in that it will accommodate any small size plastic bag.

PREFERRED EMBODIMENT OF THE PRESENT INVENTION

The drawings illustrate the present invention, namely frame 1.

Figure 1A:
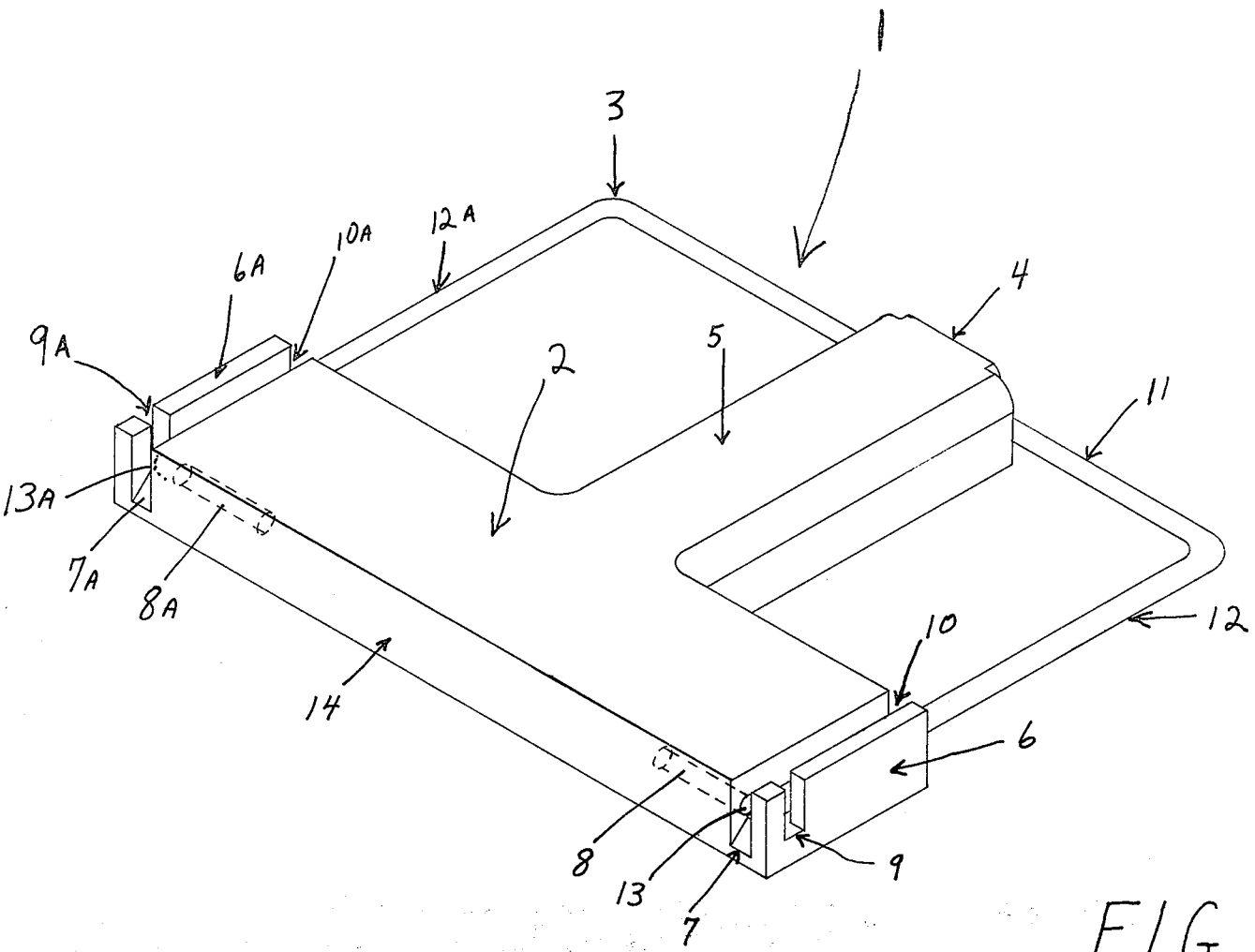
FIG. 1*a* is a perspective view of the present invention with the pivotable wire hoop depicted in the stowed position for portability.
Figure 1B:
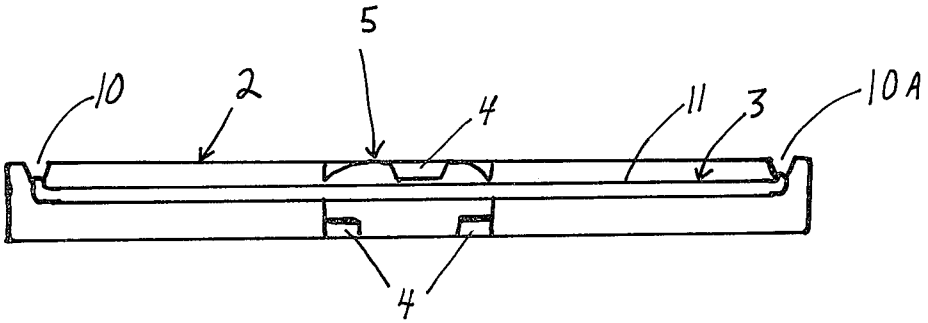
FIG. 1*b* is a plane view of the present invention showing the hidden side of the view in FIG. 1*a*.
Figure 2:
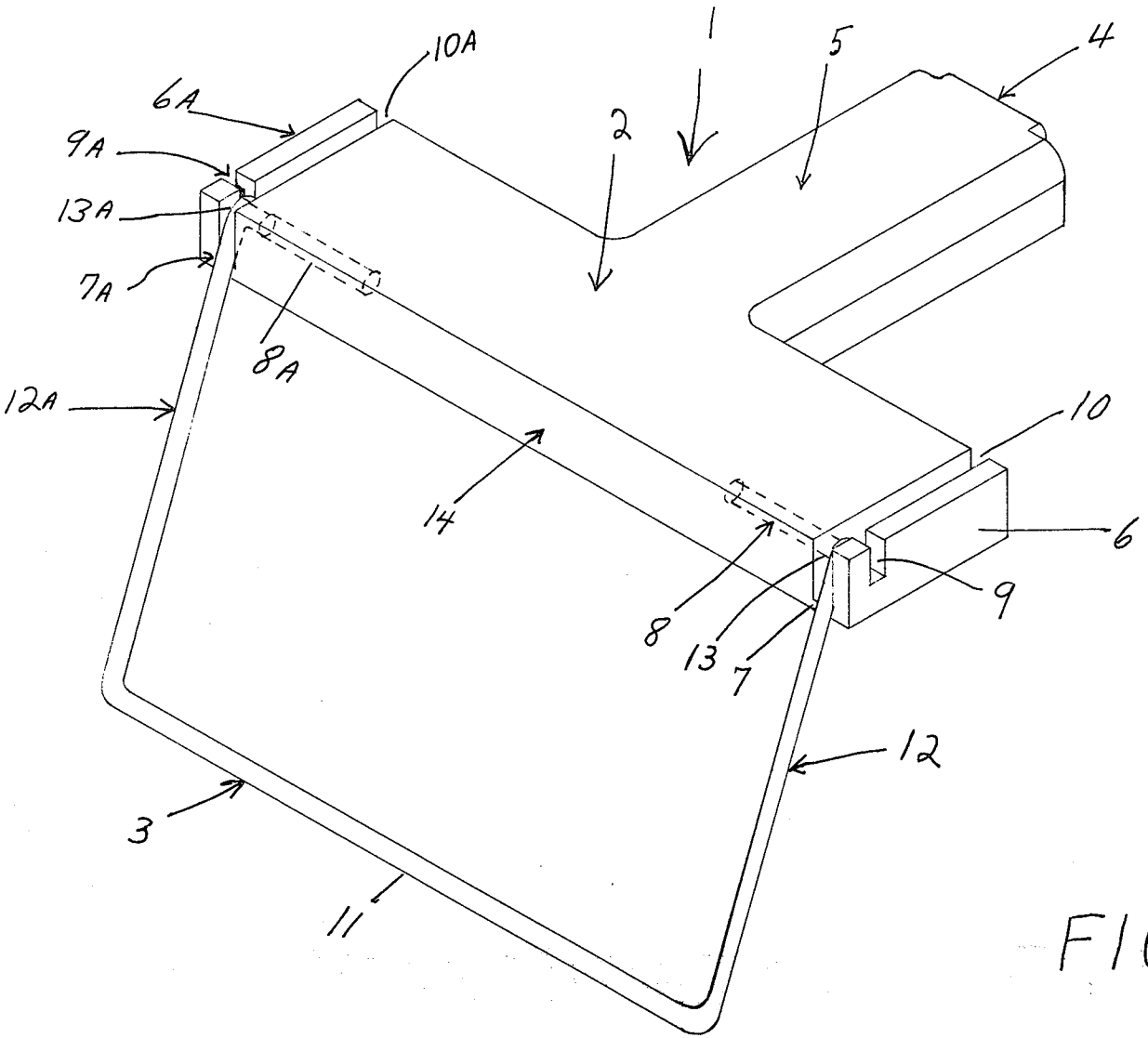
FIG. 2 is a perspective view of the present invention with the pivotable wire hoop depicted in the operable position.

In FIGS. 1*a* and *b*, frame 1 includes a molded handle 2, and wire hoop 3, assembled such that said hoop 3 can pivot in handle 2 from the stow position as depicted in FIGS. 1*a* and *b* to the operable position as shown in FIG. 2.

Hoop 3 consists of heavy gauge steel wire or bendable steel rod. Hoop 3 forms a partially closed rectangle whereas the cross portion 11 is at right angles with sides 12 and 12A and parallel with the captured, rotatable loop ends 13 and 13A. Hoop ends 13 and 13A are inserted into hoop pivot bores 8 and 8A in handle 2 via assembly access openings 9 and 9A.

Handle 2 is a "T" shaped part having a tang 5 providing a means by which a hand can grip and maneuver frame 1 to accomplish the task of scooping up animal excrement. Tang 5 forms the stem portion of the "T" in the "T" shaped handle 2. At the end of tang 5, hoop stow retainer 4 forms a means to lock hoop 3 in the stowed position for portability. Retainer 4 includes two parallel ridges between which hoop 3 snaps when in the stowed positioned. Handle 2 provides hoop retaining grooves 10 and 10A to facilitate hoop 3 when in its stowed position for compactness and portability. Hoop retainers 6 and 6A provide one side of grooves 10 and 10A and act to retain hoop ends 13 and 13A securely in hoop pivot bores 8 and 8A. The frontal portion of the hoop retaining grooves 10 and 10A is shaped such as to provide a hoop stop 7 and 7A. Whereas hoop 3 will travel approximately 240 degrees from its stowed position as shown in FIGS. 1*a* and *b* and stop in the operable position by means of hoop stops 7 and 7A as shown in FIG. 2.

Figure 3:
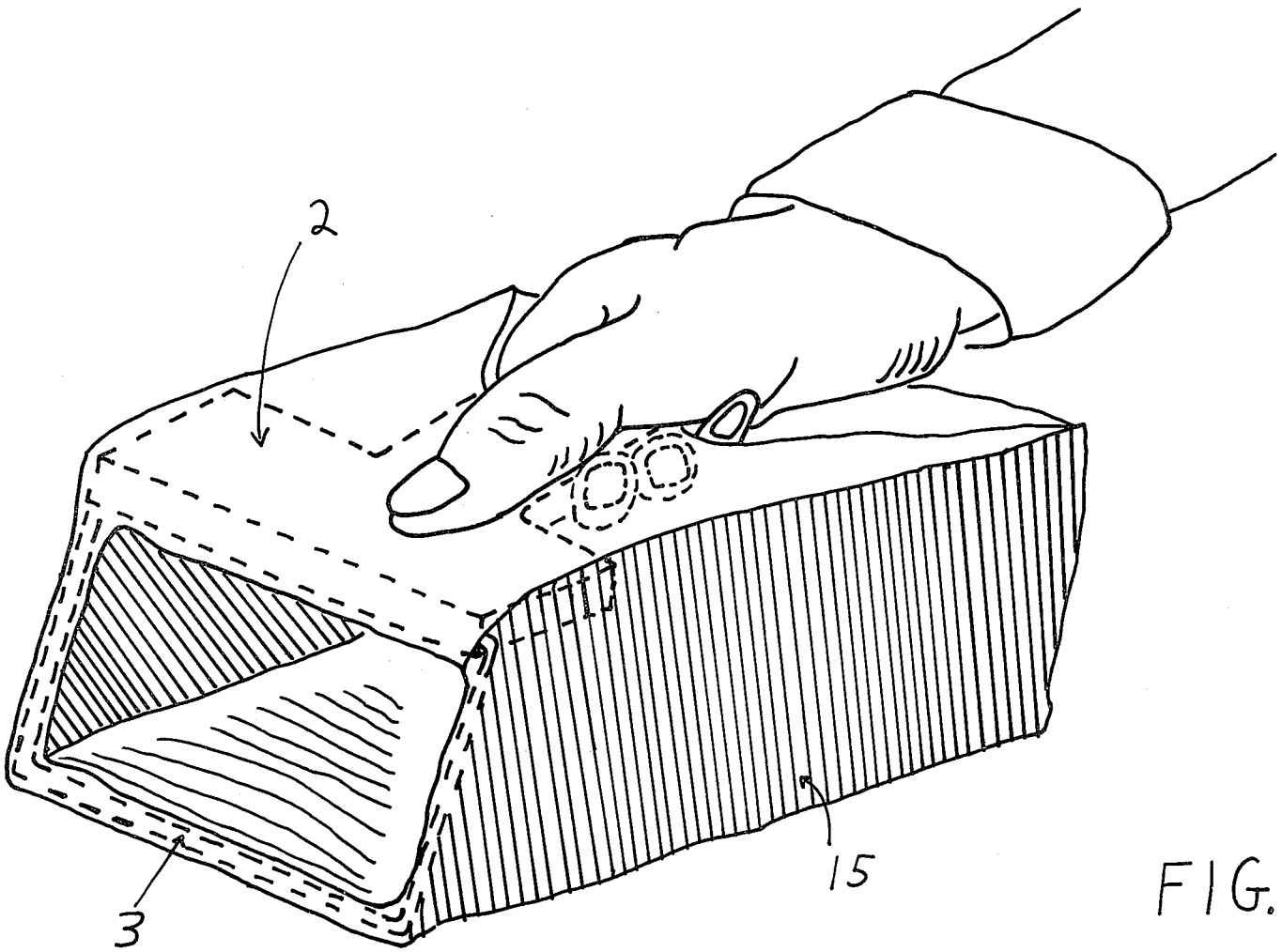
FIG. 3 is a perspective embodiment of FIG. 2 with a plastic bag installed ready for use.

With hoop 3 positioned as illustrated in FIG. 2; handle forward edge 14 forms the top portion of the rectangular support. Whereas, hoop 3 forms the sides 12 and 12A and cross member 11 of said rectangular support. The rectangular support forms a frame for pliable bag 15 as depicted in FIG. 3. With said bag 15 inserted as depicted in FIG. 3, the scoop is now ready for service. The scoop with the open end of said bag 15 is positioned such that the hoop cross member 11 is in planar alignment with the surface on which the animal excrement is deposited. The hand maneuvers the apparatus in a scooping motion passing that portion of bag 15 supported by hoop cross member 11 under said excrement. The apparatus is now lifted and the open end of bag 15 is now above the closed end of said bag 15. The excrement is forced by gravity down deeper inside bag 15. The folded portion of bag 15 can now be unfolded and removed for proper disposal without soiling hands or clothing. Wire hoop 3 is clean, having been protected by bag 15, and can now be returned to the stowed position as depicted in FIGS. 1*a* and *b* for portability.

I claim:

1. A pocket-sized collapsable frame comprising:

a T shaped handle dimensioned to fit within a clothing pocket wherein the central leg of the T forms a grasping means for grasping the frame during use, and the cross bar portion of the T shaped handle being at least as long as the central leg;

a rectangular wire hoop having two side portions and a cross member portion joining the two side portions, each of said two side portions being rotatably affixed to opposite ends of the cross bar portion of the T shaped handle;

said rectangular wire hoop being stowable with the plane defined by its two side portions and its cross member portion in generally the same plan defined by the T shaped handle with the cross member portion thereof adjacent the free end of the central leg of the T shaped handle; and said rectangular hoop being deployable with the cross member portion being forward of, below, and substantially parallel to the maximum axis of the cross bar of the T shaped handle when the handle is held parallel to the ground for receiving a flexible container within the opening formed by the rectangular hoop and the cross bar portion of the T shaped handle.

2. An apparatus as in claim 1 wherein the free end of the central leg of the T shaped handle further includes a snap means for retaining said rectangular hoop in the stowed position.

* * * * *